US007373906B2

(12) United States Patent
Fattorusso

(10) Patent No.: US 7,373,906 B2
(45) Date of Patent: May 20, 2008

(54) POWER TOOL

(75) Inventor: Antonio Fattorusso, Leinfelden-Echterdingen (DE)

(73) Assignee: Andreas Stihl AG & Co. KG, Waiblingen, DE (US)

( * ) Notice: Subject to any disclaimer, the term of this patent is extended or adjusted under 35 U.S.C. 154(b) by 0 days.

(21) Appl. No.: 11/616,941

(22) Filed: Dec. 28, 2006

(65) Prior Publication Data

US 2007/0157914 A1 Jul. 12, 2007

(30) Foreign Application Priority Data

Jan. 12, 2006 (DE) ..... 10 2006 001 567

(51) Int. Cl.
*F02B 25/00* (2006.01)

(52) U.S. Cl. ..... 123/73 PP; 123/65 R; 123/73 R

(58) Field of Classification Search ..... 123/73 R, 123/41.6, 257, 65 R, 73 PP
See application file for complete search history.

(56) References Cited

U.S. PATENT DOCUMENTS 1,149,178 A 8/1915 Francis
2,121,409 A * 6/1938 Ricardo ..... 123/65 VA
3,581,717 A * 6/1971 Fullerton ..... 123/41.67
4,382,333 A * 5/1983 Nagashima et al. ..... 30/381
6,112,708 A 9/2000 Sawada et al.
6,497,204 B1 12/2002 Miyazaki et al.
6,662,765 B2 * 12/2003 Araki ..... 123/73 A
2002/0152747 A1 10/2002 Blair et al.
2004/0251564 A1 * 12/2004 Mavinahally ..... 261/23.3

FOREIGN PATENT DOCUMENTS

JP 2001355451 A 12/2001

* cited by examiner

*Primary Examiner*—Stephen K. Cronin
*Assistant Examiner*—J. Page Hufty
(74) *Attorney, Agent, or Firm*—Gudrun E. Huckett

(57) ABSTRACT

A power tool is driven by a two-stroke engine. The two-stroke engine has a cylinder and a piston reciprocating within the cylinder. The cylinder has a combustion chamber delimited by the piston. The two-stroke engine has a crankcase and a crankshaft rotatably supported in the crankcase and driven by the piston with a connecting rod. The two-stroke engine has one or more transfer passages connecting the crankcase to the combustion chamber in at least one position of the piston. The two-stroke engine has a mixture passage that is connected to a piston-controlled mixture intake provided at the cylinder and supplies a fuel/air mixture. The combustion chamber has an exhaust port provided within the cylinder. The two-stroke engine has a transverse plane dividing the cylinder parallel to and along the longitudinal cylinder axis. The exhaust port and the mixture intake are arranged on the same side of the transverse plane.

11 Claims, 4 Drawing Sheets

POWER TOOL

BACKGROUND OF THE INVENTION

The invention relates to a power tool comprising a working tool that is driven by a two-stroke engine. The two-stroke engine comprises a cylinder having a combustion chamber arranged therein. The combustion chamber is delimited by a piston, wherein the piston is movably supported within the cylinder in the direction of a longitudinal axis of the cylinder and drives by means of a connecting rod a crankshaft that is rotatably supported about an axis of rotation in the crankcase. In at least one position of the piston, the crankcase is in flow communication with the combustion chamber by means of a transfer passage. A mixture passage for supplying a fuel/air mixture is provided that opens by means of a mixture intake into the cylinder. The mixture intake is piston-controlled. The combustion chamber has an exhaust port. The two-stroke engine has a transverse plane that divides the cylinder parallel to the longitudinal axis of the cylinder; the longitudinal axis of the cylinder is located within the transverse plane. The exhaust port of the combustion chamber is arranged on one side of the transverse plane.

U.S. Pat. No. 6,112,708 discloses a two-stroke engine for a power tool. The two-stroke engine has a mixture passage that has a mixture intake opening into the cylinder. The mixture intake is arranged at the cylinder on the side opposite the exhaust port of the combustion chamber. Relative to an imaginary transverse plane through which the longitudinal cylinder axis extends, on one side of the transverse plane the exhaust port is arranged and the mixture intake is arranged on the opposite side of the transverse plane.

U.S. Pat. No. 6,497,204 B1 discloses a two-stroke engine in which scavenging air is supplied below the exhaust port of the combustion chamber. The air passage is connected by means of two piston recesses with the transfer passage of the two-stroke engine. In operation of the engine, the piston recess must not connect the exhaust port and the air intake. For this reason, the piston of the two-stroke engine must have a comparatively tall configuration so that the piston recess does not open toward the exhaust port, not even when the piston is at the top dead center.

SUMMARY OF THE INVENTION

It is an object of the present invention to provide a power tool of the aforementioned kind that has a compact configuration.

In accordance with the present invention, this is achieved in that the mixture intake and the exhaust port are arranged on the same side of the transverse plane. By arranging the mixture intake and the exhaust port on the same side of the transverse plane (within the same half of the cylinder), the two-stroke engine can have a compact configuration, in particular when being operated with scavenging air. The piston controls with its upper edge the exhaust port and with its lower edge the mixture intake. In this way, the piston can have a short configuration, and the exhaust port and the mixture intake can be arranged directly adjacent to one another in the direction of the longitudinal cylinder axis.

The mixture intake opens into the crankcase in particular on the side of the exhaust port facing the crankcase so as to be adjacent to the exhaust port. It is provided that the two-stroke engine has an air passage that supplies combustion air and opens with its air intake into the cylinder wherein the air intake is arranged on the side of the transverse plane opposite the exhaust port. By arranging the mixture intake on the side of the transverse plane where the exhaust port is also arranged, a sufficiently large space for the air passage is provided on the opposite side of the transverse plane. Advantageously, the transfer port of the transfer passage opens into the combustion chamber, and the air passage is connected by the piston recess to at least one transfer port of the transfer passage in at least one position of the piston. Since the mixture intake opens into the cylinder at the side opposite the air passage, there is no limitation with regard to the height of the piston recess. By means of the piston side that is opposite the exhaust port, the connection between the air passage and the transfer passage is exclusively controlled so that the piston recess can be designed as desired. Accordingly, an excellent filling of the transfer passages with scavenging air can be realized. In particular, the air passage opens with a single air intake into the cylinder and the piston recess is connected to the transfer ports of all transfer passages in at least one position of the piston. A division of the air passage into several branches can thus be avoided. The piston recess can extend about a significant portion of the circumference of the piston and can be designed to be correspondingly large so that a minimal flow resistance results within the piston recess. In this way, an excellent filling of the transfer passages can be achieved. Since the flow resistance is minimal, it is also possible to keep the extension of the piston recess small in a direction parallel to the cylinder axis so that also the height of the piston is very small. In this way, the size of the motor and thus also that of the power tool can be reduced. Advantageously, the air intake opens, viewed in the circumferential direction of the piston, in a central area of the piston recess. In this way, a uniform filling of the transfer passages with scavenging air can be achieved.

Expediently, the air passage and the mixture passage extend with their entire length on opposite sides of the transverse plane. In this way, the passages can be positioned close to the cylinder so that a compact configuration of the two-stroke engine results.

Advantageously, the axis of rotation of the crankshaft extends perpendicularly to the transverse plane. It is provided that the two-stroke engine has a center plane that divides the exhaust port of the combustion chamber wherein on either side of the center plane at least one transfer passage is arranged. The main flow direction in the exhaust port extends advantageously parallel to the center plane. The center plane is positioned in particular perpendicularly to the transverse plane, and the longitudinal cylinder axis and the axis of rotation of the crankshaft are located therein. Therefore, the crankshaft does not extend perpendicularly to the mixture intake and the exhaust port but essentially parallel thereto, i.e., relative to the prior art it is rotated by 90 degrees about the longitudinal cylinder axis. In this way, the space that is available in the power tool can be utilized excellently.

Expediently, the two-stroke engine has a carburetor in which a mixture passage section is formed and in which a throttle element is pivotably supported. It is provided that the two-stroke engine has an air passage component in which an air passage section is provided and in which a choke is pivotably supported. The carburetor and the air passage component are in particular arranged at the level of the cylinder head of the cylinder. The power tool has expediently a power tool housing and an top handle that extends across the top side of the housing. The two-stroke engine is arranged in the power tool housing advantageously in such a way that the transverse plane of the two-stroke engine is parallel to the longitudinal direction of the top handle. The two-stroke engine is thus arranged in the longitudinal direction of the power tool that is defined by the top handle. As a result of the orientation of the two-stroke engine and of the top handle in the same direction, a beneficial weight distribution results so that the power tool can be easily handled without causing fatigue. The carburetor is advantageously arranged on the side of the cylinder which is facing the top handle. The two-stroke engine is expediently arranged horizontally in the power tool housing i.e., it is not upright within the power tool housing but lying in the power tool housing. In this way, the power tool can be configured to have minimal height; this facilitates handling.

DESCRIPTION OF THE PREFERRED EMBODIMENTS

Figure 1:
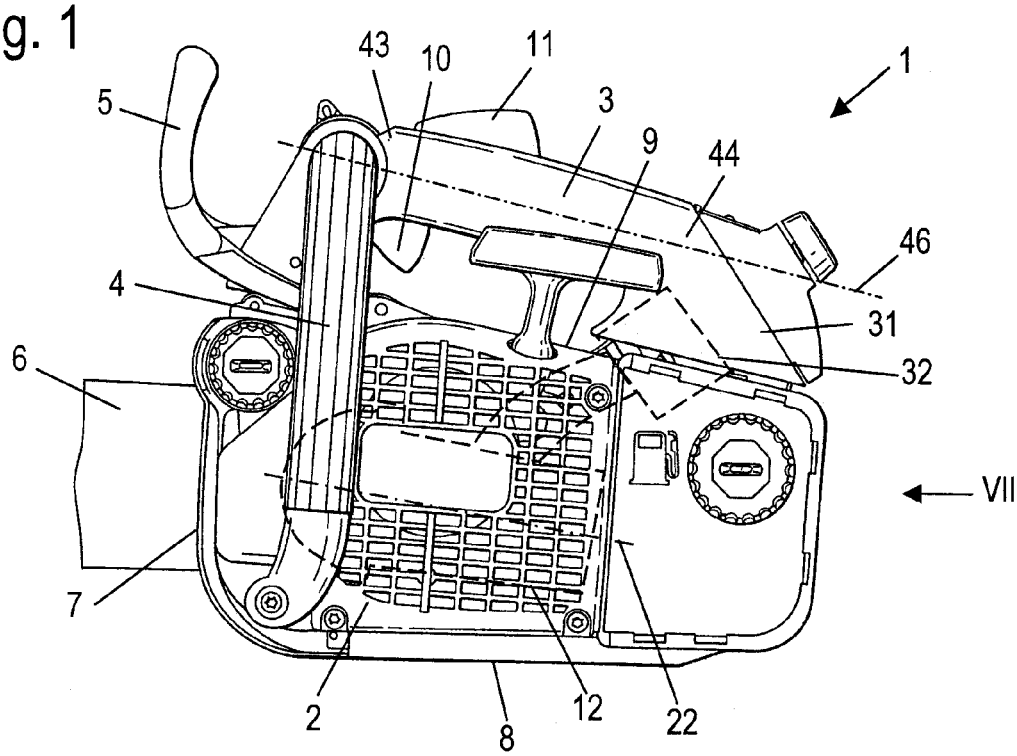
FIG. 1 is a side view of a power tool according to the invention.

FIG. 1 shows schematically in a side view a hand-held power tool in the form of a motor chainsaw 1. The motor chainsaw 1 has a housing 2 having at its top side 9 and top handle 3. At the front end 7 of the housing 2 a guide bar 6 is provided about which a saw chain, not illustrated, circulates. The saw chain is driven by a two-stroke engine 12 that is arranged in the power tool housing 2. When the motor chainsaw 1 is placed on the ground, for example, the top side 9 of the housing 2 is facing upwardly and the opposite side of the power tool housing 2 rests on the ground with its bottom side 8. The two-stroke engine 12 is not upright but is lying in the power tool housing 2, i.e., is substantially horizontal. The longitudinal cylinder axis 22 of the two-stroke engine 12 extends thus approximately horizontally when the motor chainsaw 1 is put down (see FIG. 1).

The top handle 3 has a leading end 43 where a first end of a grip pipe 4 is attached. The second end of the grip pipe 4 is secured on the power tool housing 2 adjacent the bottom side 8 of the power tool housing 2. In the area of the front end 7 of the power tool housing 2, a hand guard 5 is supported on the power tool housing 2. Adjacent to the front end 43, a throttle lever 10 and a throttle lock 11 are arranged on the top handle 3. The top handle 3 has a longitudinal axis 46 that is slanted slightly relative to the bottom side 8 of the housing 2 and is parallel to the extension of the guide bar 6. The top handle 3 has a rearward portion 44 attached to the power tool housing 2. The top handle 3 has a grip housing 31. In the grip housing 31 a carburetor 32 is arranged that supplies the two-stroke engine 12 with fuel/air mixture. The carburetor 32 can be arranged entirely or partially in the grip housing 31.

Figure 2:
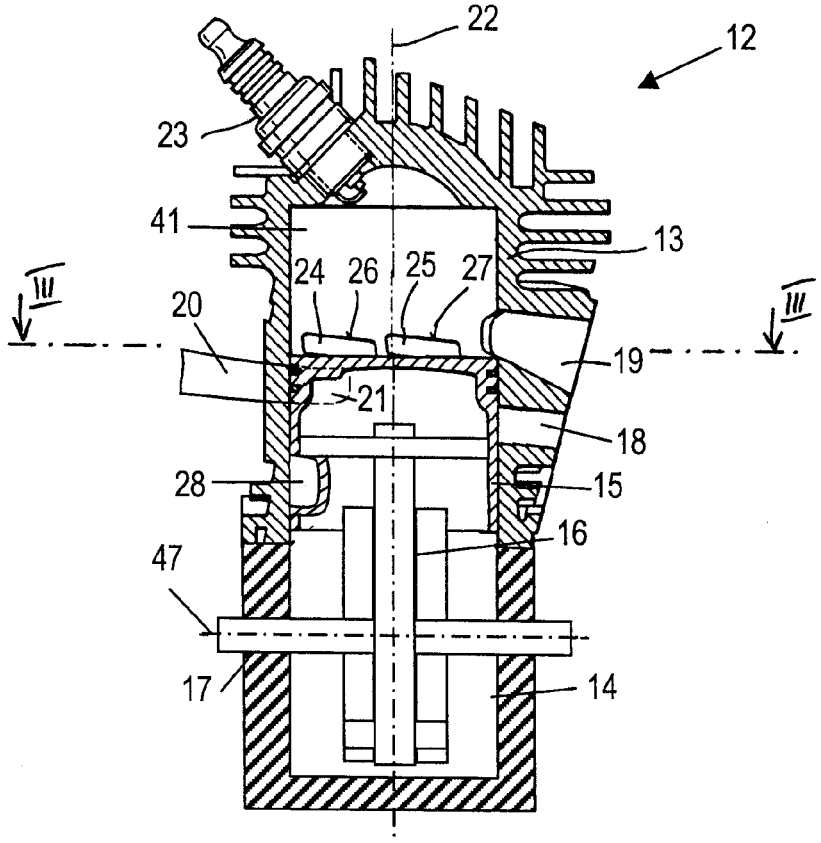
FIG. 2 is a schematic longitudinal section view of the two-stroke engine.
Figure 3:
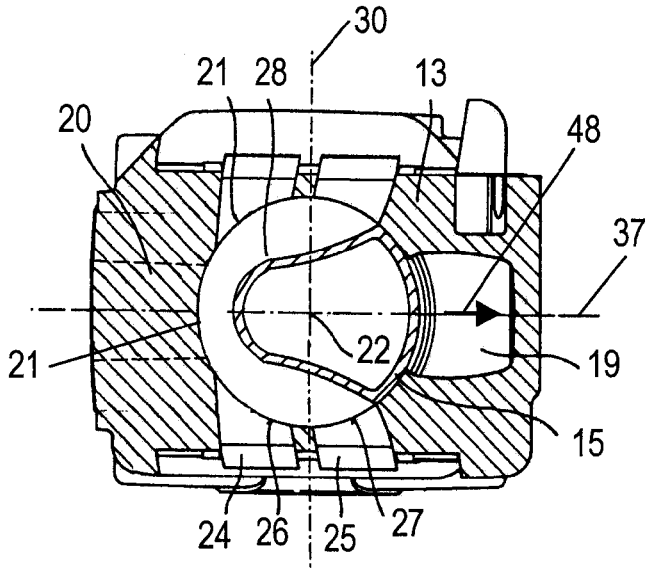
FIG. 3 is a section view of the cylinder of the two-stroke engine along section line III-III of FIG. 2 showing the piston at the top dead center.

In FIGS. 2 and 3, the two-stroke engine 12 is schematically illustrated. The two-stroke engine 12 has a cylinder 13 in which a piston 15 is movably supported in the direction of the longitudinal cylinder axis 22. By means of a connecting rod 16, the piston 15 drives a crankshaft 17 that is rotatably supported in the crankcase 14 about axis of rotation 47. A mixture intake 18 provided at the cylinder 13 opens into the crankcase 14. The cylinder 13 has an exhaust port 19 leading away from the combustion chamber 41. The combustion chamber 41 is formed in the cylinder 13 and is delimited by the cylinder 15. The mixture intake 18 and the exhaust port 19 are controlled by the piston 15.

In the area of the bottom dead center of the piston 15 illustrated in FIG. 2, the crankcase 14 is connected to the combustion chamber 41 by means of a total of four transfer passages 24, 25. As shown in FIG. 3, the transfer passages 24, 25 are symmetric to the center plane 37. The two-stroke engine 12 has a total of four transfer passages 24, 25; two are arranged on either side of the center plane 37, respectively. The center plane 37 divides the exhaust port 19 centrally; the cylinder axis 22 is located in the center plane 37. As shown in FIG. 2, a spark plug 23 projects into the combustion chamber 41.

An air passage 20 opens into the cylinder 13 by means of an air intake 21. The piston 15 has a piston recess 28 that extends about approximately ¾ of the circumference of the piston 15. Through the piston recess 28 the air intake 21 is connected in the area of the top dead center of the piston 15 to the transfer ports 26 and 27 of all transfer passages 24, 25.

In operation of the two-stroke engine 12, the fuel/air mixture flows in the area of the top dead center of the piston 15 through the mixture intake 18 into the crankcase 14. Substantially fuel-free combustion air flows into the transfer passages 24 and 25 through the air intake 21 and the piston recess 28. Upon downward stroke of the piston 15 the fuel/air mixture in the crank case 14 is compressed. As soon as the piston 15 opens the transfer ports 26, 27 toward the combustion chamber 41, the combustion air stored in the transfer passages 24, 25 flows into the combustion chamber 41 and flushes exhaust gases still contained within the combustion chamber 41 through the exhaust port 19 out of the combustion chamber 41. Subsequently, fresh fuel/air mixture from the crankcase 14 flows through transfer passages 24, 25 into the combustion chamber 41. During the upward stroke of the piston 15, the fuel/air mixture in the combustion chamber 41 is compressed and ignited in the area of the top dead center of the piston 15 by the spark plug 23. As a result of the combustion, the piston 15 is accelerated toward the crankcase 14. As soon as the exhaust port 19 is opened by the piston 15, the exhaust gases flow out of the combustion chamber 41 through the exhaust port 19. Subsequently, combustion air and fresh fuel/air mixture flow from the crankcase 14 flow into the combustion chamber 41 and the next working cycle is started.

Figure 4:
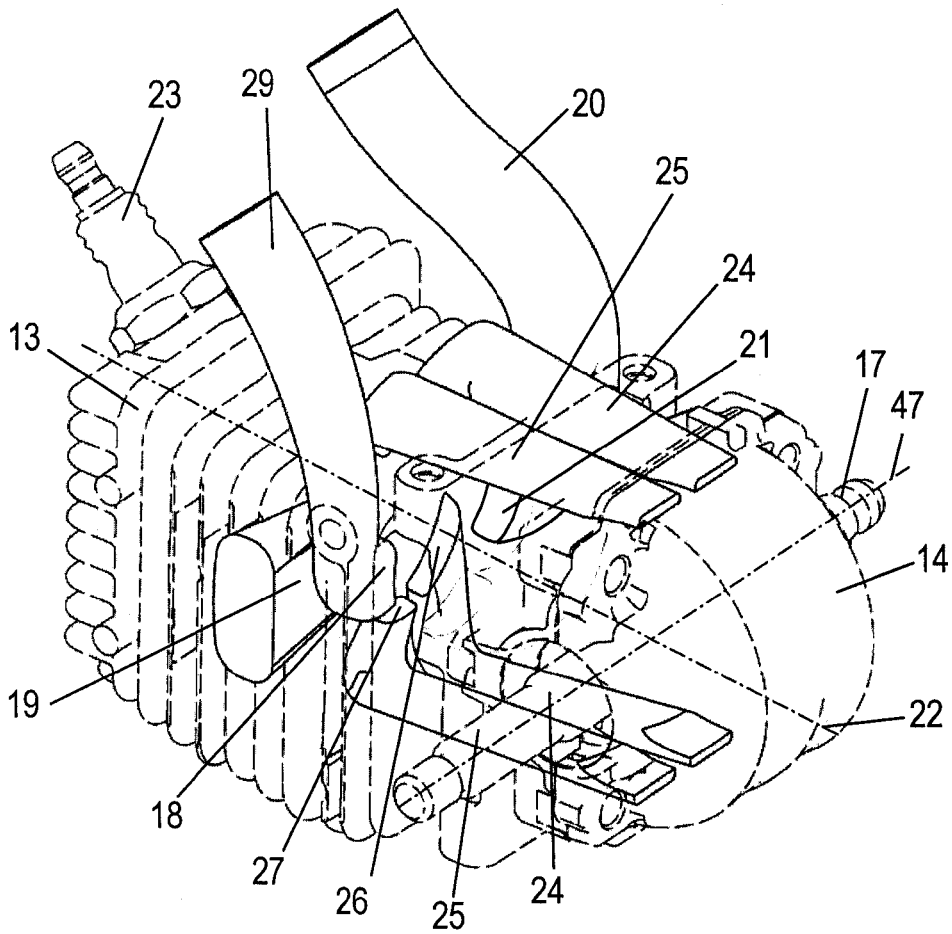
FIG. 4 is a perspective schematic illustration of the two-stroke engine.

As illustrated in FIG. 4, the two transfer passages 25 are arranged near the exhaust port 19 and the two transfer passages 24 are located adjacent to the air intake 21. The mixture intake 18 is arranged directly adjacent to the exhaust port 19 on the side of the exhaust port 19 facing the crankcase 14. On the opposite cylinder side, the air intake 21 is provided. The two-stroke engine 12 has a transverse plane 30, shown in FIG. 3, in which the longitudinal cylinder axis 22 is located. The transverse plane 30 extends perpendicularly to the axis of rotation 47 of the crankshaft 17 (FIG. 4) and divides the cylinder 13 into two halves. The exhaust port 19 and the mixture intake 18 are arranged on one side of the transverse plane 30 and the air intake 21 on the opposite side of the transverse plane 30. A mixture passage 29 is connected to the mixture intake 18.

Figure 5:
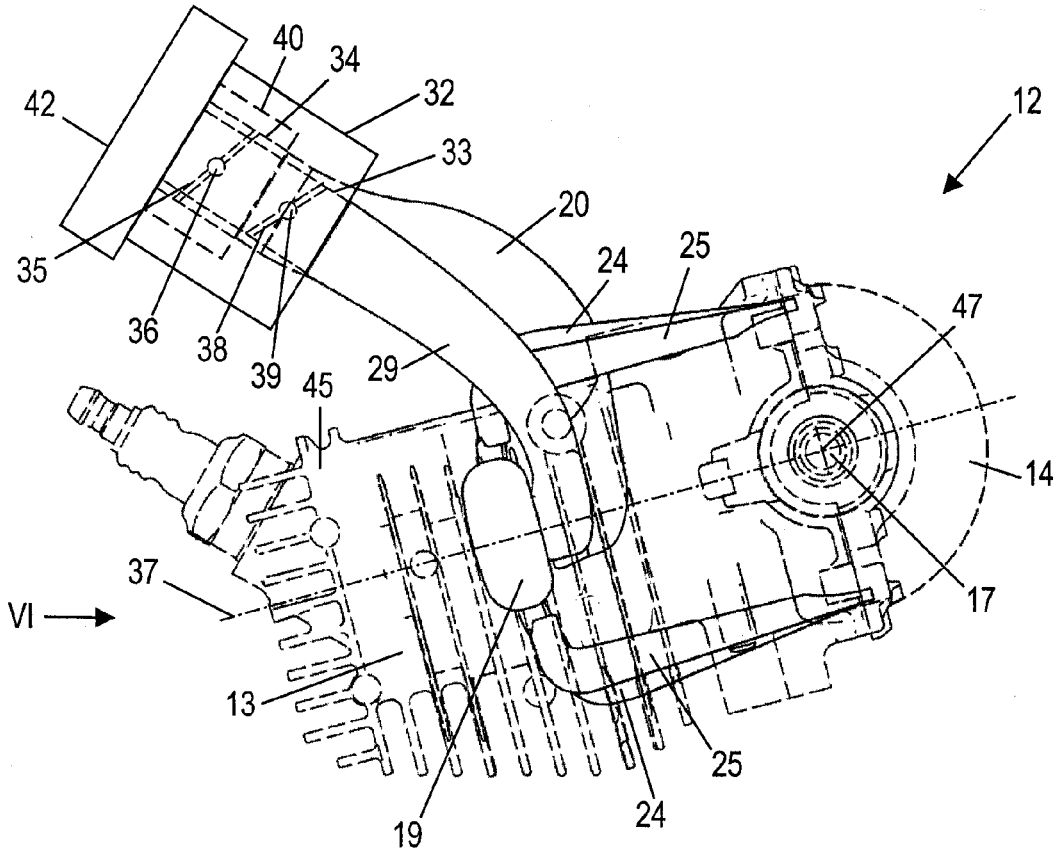
FIG. 5 is a side view of the two-stroke engine of FIG. 4 showing the carburetor arranged thereat.

As shown in FIG. 5, the mixture passage 29 connects the mixture intake 18 to the carburetor 32. A mixture passage section 33 is formed in the carburetor 32. In the mixture passage 33 a throttle 38 is pivotably supported by means of throttle shaft 39. The air passage 20 is connected to an air passage component 40 in which an air passage section 34 is provided. In the air passage section 34 a choke 35 is pivotably supported by means of choke shaft 36. It is also possible to provide other kinds of throttle elements in the air passage or the mixture passage. The choke 35 is connected by means of a coupling device, not illustrated, to the throttle 38 so that the position of the choke 35 is coupled at least in one range of movement of the throttle 38 to the movement of the throttle 38. An adjustment of the throttle 38 effects thus at the same time an adjustment of the choke 35. Upstream of the throttle 38 a choke elements can be arranged. The mixture passage 29 as well as the air passage 20 are connected to the clean side of an air filter 42. The carburetor 32 and the air passage component 40 are arranged approximately at the level of the cylinder head 45 of the two-stroke engine 12. Relative to the cylinder head 45, the carburetor 32 and the air passage component 40 are thus positioned in a direction perpendicular to the longitudinal cylinder axis 22.

Figure 6:
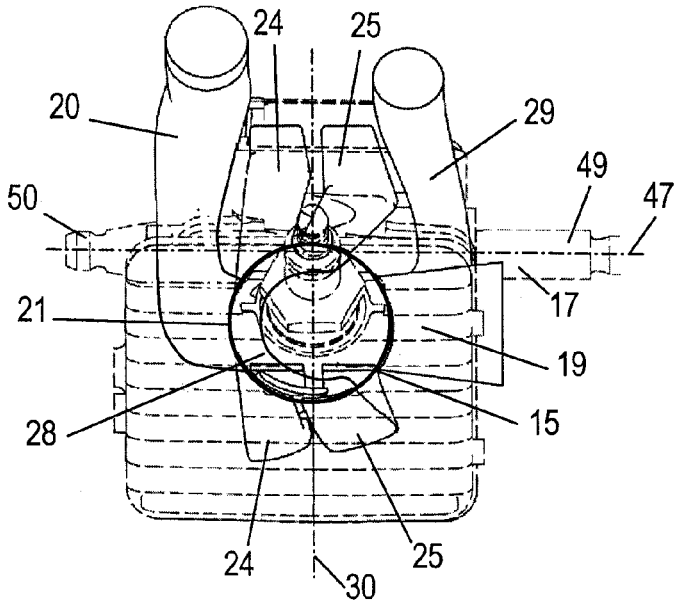
FIG. 6 is an end view of the two-stroke engine in the direction of arrow VI of FIG. 5.
Figure 7:
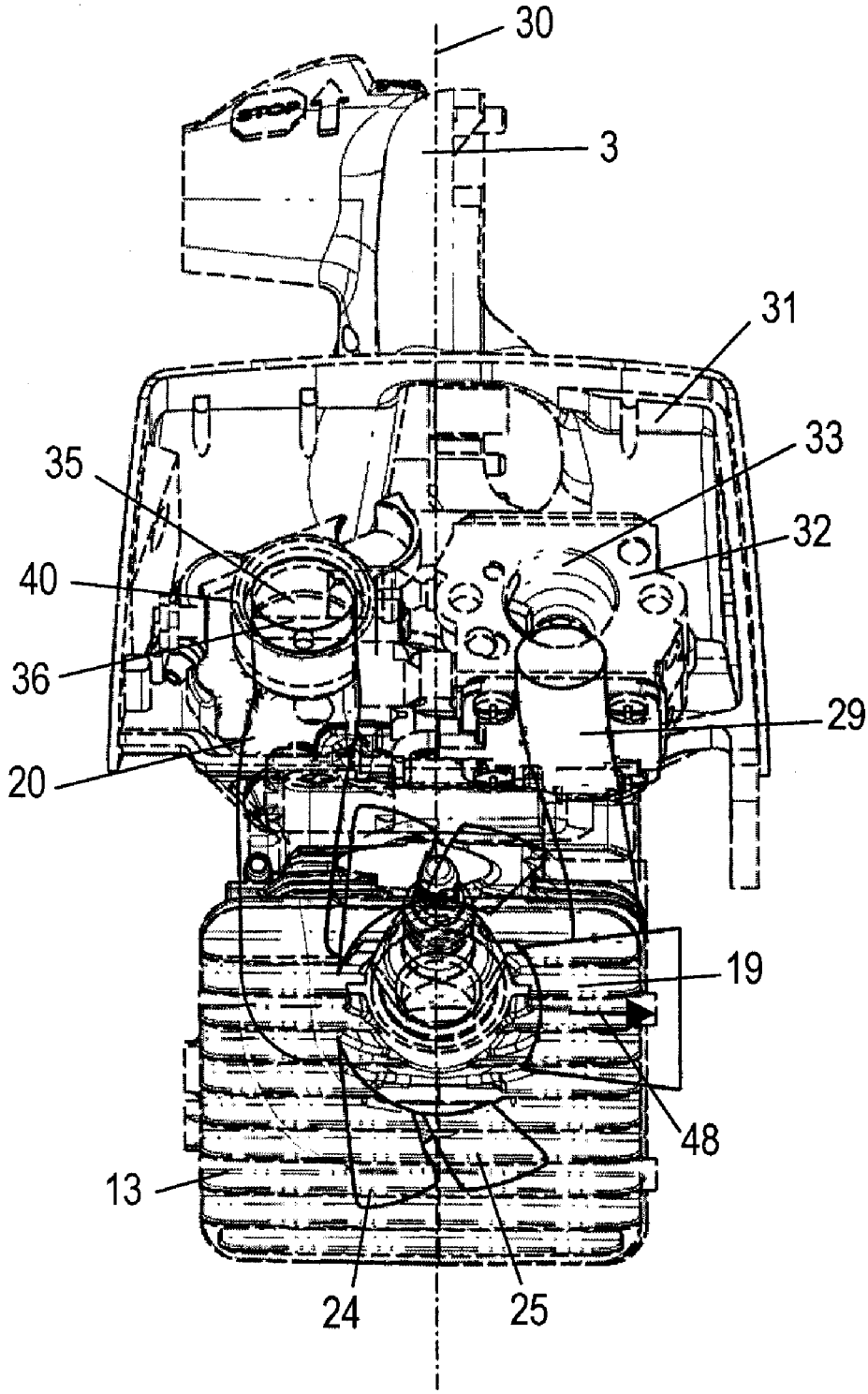
FIG. 7 is an end view of the two-stroke engine in the grip housing of the power tool viewed in the direction of arrow VII of FIG. 1.

FIG. 6 shows that the air passage 20 and the mixture passage 29 extend across their entire length on opposite sides of the transverse plane 30. The air intake 21 opens in the circumferential direction approximately centrally into the piston recess 28. The axis of rotation 47 of the crankshaft 17 is positioned perpendicularly to the transverse plane 30. A first end 49 of the crankshaft 17 is positioned below the exhaust port 19 and the opposed second end 50 of the crankshaft 17 is positioned below the air intake 21. As shown in the illustration of FIG. 7, the carburetor 32 and the air passage component 40 are arranged in the grip housing 31 of the motor chainsaw 1. Also, the carburetor 32 and the air passage component 40 are arranged on opposite sides of the transverse plane 30 so that the air passage 20 and the mixture passage 29 extend about their entire length from the air filter 42 (not shown in FIG. 7) to the cylinder 13 of the two-stroke engine 12 on opposite sides of the transverse plane 30.

The main flow direction 48 in the exhaust port 19 illustrated in FIG. 3 is parallel to the center plane 37 (FIG. 3). The exhaust port 19 is oriented transversely to the transverse plane 30. In the mounted position of the two-stroke engine 12 within the power tool housing 2 illustrated in FIG. 1, the main flow direction 48 in the exhaust port 19 is approximately parallel to the bottom side 8 of the power tool housing 2 and slanted to the front end 7. When placing the motor chainsaw 1 onto the ground, the exhaust gases flow out of the exhaust port 19 approximately horizontally. In this way, it is prevented that the hot exhaust gases can set on fire objects that are located on the ground, for example, leaves or the like.

The specification incorporates by reference the entire disclosure of German priority document 10 2006 001 567.3 having a filing date of Jan. 12, 2006.

While specific embodiments of the invention have been shown and described in detail to illustrate the inventive principles, it will be understood that the invention may be embodied otherwise without departing from such principles.

What is claimed is:

1. A power tool comprising:

a working tool;

a two-stroke engine driving the working tool;

the two-stroke engine comprising a cylinder and a piston reciprocating within the cylinder in a direction of a longitudinal cylinder axis, wherein the cylinder has a combustion chamber delimited by the piston;

the two-stroke engine comprising a crankcase and a crankshaft rotatably supported in the crankcase about an axis of rotation, wherein the piston drives with a connecting rod the crankshaft;

the two-stroke engine having one or more transfer passages connecting the crankcase to the combustion chamber in at least one position of the piston;

the two-stroke engine comprising a mixture passage supplying a fuel/air mixture, wherein the cylinder has a mixture intake that is connected to the mixture passage and is piston-controlled;

wherein the combustion chamber has an exhaust port provided within the cylinder;

wherein the two-stroke engine has a transverse plane dividing the cylinder parallel to the longitudinal cylinder axis into a first half and a second half, wherein the longitudinal cylinder axis is located within the transverse plane;

wherein the exhaust port and the mixture intake are arranged on the first half of the cylinder;

wherein the axis of rotation of the crankshaft extends transversely to the transverse plane;

wherein the two-stroke engine has an air passage that supplies combustion air, wherein the cylinder has an air intake and the air passage is connected to the air intake, wherein the air intake is arranged on the second half of the cylinder;

wherein the two-stroke engine has a center plane dividing the exhaust port, wherein on either side of the center plane at least one of the one or more transfer passages is arranged;

wherein the one or more transfer passages each have a transfer port opening into the combustion chamber, wherein the piston has a piston recess, and wherein the air passage is connected through the piston recess in at least one position of the piston to at least one of the transfer ports of the one or more transfer passages.

2. The power tool according to claim 1, wherein the mixture intake is arranged adjacent to the exhaust port on a side of the exhaust port facing the crankcase.

3. The power tool according to claim 1, wherein the air intake of the cylinder is the only connection of the air passage into the cylinder, wherein the piston recess in at least one position of the piston is connected to all of the transfer ports of the one or more transverse passages.

4. The power tool according to claim 3, wherein the air passage opens in a central area of the piston recess relative to a circumferential direction of the piston.

5. The power tool according to claim 1, wherein a main flow direction of the exhaust port is parallel to the center plane.

6. The power tool according to claim 1, wherein the center plane is perpendicular to the transverse plane, wherein the longitudinal cylinder axis and the axis of rotation of the crankshaft are located within the center plane.

7. The power tool according to claim 1, wherein the air passage and the mixture passage each extend completely on opposite sides of the transverse plane.

8. The power tool according to claim 1, wherein the two-stroke engine has a carburetor in which the fuel/air mixture is generated and in which a throttle element is pivotably supported, wherein the two-stroke engine further comprises an air passage component provided with an air passage section, wherein a choke is pivotable supported in the air passage component, wherein the carburetor and the air passage component are arranged at the level of a cylinder head of the cylinder.

9. The power tool according to claim 1, comprising a power tool housing and an top handle that extends across a top side of the power tool housing, wherein the two-stroke engine is arranged in the power tool housing such that the transverse plane of the two-stroke engine is parallel to the top handle.

10. The power tool according to claim 9, wherein the carburetor is arranged on a side of the cylinder that is facing the top handle.

11. The power tool according to claim 9, wherein the two-stroke engine is arranged substantially horizontally in the power tool housing.

* * * * *